US010814456B2

(12) United States Patent
Kraft et al.

(10) Patent No.: US 10,814,456 B2
(45) Date of Patent: Oct. 27, 2020

(54) UNIVERSAL ADAPTER

(71) Applicant: TKR SPEZIALWERKZEUGE GMBH, Gevelsberg (DE)

(72) Inventors: Patrick Kraft, Hemer (DE); Heiko Sirringhaus, Menden (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 158 days.

(21) Appl. No.: 15/899,519

(22) Filed: Feb. 20, 2018

(65) Prior Publication Data

US 2018/0236636 A1 Aug. 23, 2018

(30) Foreign Application Priority Data

Feb. 17, 2017 (DE) ..... 10 2017 103 300

(51) Int. Cl.

| | |
|---|---|
| ***B24C 5/04*** | (2006.01) |
| ***F02B 77/04*** | (2006.01) |
| ***B24C 3/32*** | (2006.01) |
| ***B24C 9/00*** | (2006.01) |
| ***B24C 3/06*** | (2006.01) |
| ***B24C 7/00*** | (2006.01) |

(52) U.S. Cl.

CPC ..... *B24C 5/04* (2013.01); *B24C 3/065* (2013.01); *B24C 3/32* (2013.01); *B24C 3/325* (2013.01); *B24C 7/0053* (2013.01); *B24C 9/003* (2013.01); *F02B 77/04* (2013.01)

(58) Field of Classification Search

CPC ..... B24C 3/325; B24C 3/32; B24C 3/00

USPC ..... 451/87, 88, 442, 51, 76, 29, 61, 90

See application file for complete search history.

(56) References Cited

U.S. PATENT DOCUMENTS

| | | | | |
|---|---|---|---|---|
| 2,720,057 | A | 10/1955 | Pyciak | |
| 2,723,498 | A * | 11/1955 | Hastrup | B24C 3/065 451/88 |
| 2,770,924 | A * | 11/1956 | Mead | B24C 3/065 451/88 |
| 4,232,487 | A | 11/1980 | Brown | |
| 5,161,336 | A | 11/1992 | Ritt et al. | |
| 6,012,975 | A * | 1/2000 | Jager | B24C 5/04 451/87 |
| 6,273,154 | B1 | 8/2001 | Laug | |
| 2006/0252357 | A1 * | 11/2006 | Bohler | B24C 7/0053 451/90 |

FOREIGN PATENT DOCUMENTS

| | | | |
|---|---|---|---|
| DE | 860434 | C | 12/1952 |
| DE | 3314094 | A1 | 3/1984 |

(Continued)

*Primary Examiner* — George B Nguyen

(74) *Attorney, Agent, or Firm* — Laurence A. Greenberg; Werner H. Stemer; Ralph E. Locher

(57) ABSTRACT

A universal adapter includes a main tube for a combined suction unit and blasting unit. The main tube has a first connecting section for connection to a suction line of the suction unit and a second connecting section for connection to a working chamber. In order to reduce the number of suction adapters needed to connect to different openings in working chambers, the second connecting section is made of a flexible material and has a cutout in its periphery that extends from a free end of the second connecting section in the direction of the longitudinal axis of the main pipe.

14 Claims, 2 Drawing Sheets

(56) References Cited

FOREIGN PATENT DOCUMENTS

| | | | |
|---|---|---|---|
| DE | 19802308 | A1 | 7/1998 |
| DE | 102014220140 | A1 | 4/2016 |
| EP | 2565416 | A1 | 3/2013 |
| GB | 684905 | A | 12/1952 |
| GB | 2021450 | A | 12/1979 |

* cited by examiner

UNIVERSAL ADAPTER

CROSS-REFERENCE TO RELATED APPLICATION

This application claims the benefit, under 35 U.S.C. § 119, of German Patent Application DE 10 2017 103 300.9, filed Feb. 17, 2017; the prior application is herewith incorporated by reference in its entirety.

BACKGROUND OF THE INVENTION

Field of the Invention

The invention relates to a universal adapter with a main tube for a suction unit combined with a granulate blasting unit, wherein the main tube has:

- a first connecting section for connection to a suction line of the suction unit, and
- a second connecting section for connection to a working chamber.

Granulate blasting units are used in particular to free surfaces of any working chambers from impurities. In the process, the abrasive present as granules is guided under pressure to the surfaces to be cleaned, and in the process removes even strongly adhesive impurities. An area of use for such blasting units is in motor vehicle workshops where the blasting units are used to clean intake and discharge ports of cylinder heads of motor vehicle engines. In so doing, the abrasive introduced at a high pressure into the intake ports forming the working chamber removes impurities and coking from the inner walls of the intake ports as well as from the surfaces of the intake valves.

In order to ensure proper cleaning, it is necessary to again remove both the abrasive blown into, for example, the intake ports of the cylinder heads, as well as the removed impurities from the working chamber. When using blasting units to clean the intake ports of cylinder heads, it is known to use so-called suction adapters in the corresponding openings in the cylinder head that are connected to the suction units which are combined with the granule blasting unit. In addition to an abrasive-tight connection to a suction line of the suction unit, an abrasive-tight configuration of the suction adapter in the opening of the working chamber, such as the cylinder head opening, is particularly significantly important for preventing the abrasive from exiting which can cause user injury during operation and also negatively influences the cleaning results.

The varying construction of the cylinder heads and their openings therefore renders it necessary to keep in the workshop a correspondingly adapted suction adapter for each cylinder head that enables an abrasive-tight connection of the suction adapter to the cylinder head and hence safe working.

SUMMARY OF THE INVENTION

It is accordingly an object of the invention to provide a universal adapter, which overcomes the hereinafore-mentioned disadvantages of the heretofore-known adapters of this general type and which reduces the number of suction adapters needed to connect to different openings in working chambers.

With the foregoing and other objects in view there is provided, in accordance with the invention, a universal adapter, which comprises a first connecting section for connecting to a suction line of the suction unit and a second connecting section for connecting to the working chamber, the second connecting section being formed of a flexible material and having a cutout in its periphery that extends proceeding from a free end of the second connecting section in the direction of the longitudinal axis of the main tube.

According to the invention, it is therefore provided that the second connecting section—which is a region of the main tube with which the universal adapter is inserted, for example, in an opening of the cylinder head—is formed of a flexible material, and moreover has a cutout in the region of the second connecting section extending from its free end in the direction of the longitudinal axis of the main tube.

The cutout penetrating the tube casing as well as the construction of the second connecting section from a flexible material make it possible to reduce the diameter of the second connecting section by compressing or upsetting, in which case the opposing surfaces of the cutout are moved towards each other until they lie against each other. The option of changing the diameter makes it possible to also place the universal adapter in such openings of the working chamber, in particular the intake ducts of the cylinder head, with an opening width that is less than the diameter of the second connecting sections in the position in which it is not reduced by compressing or upsetting the cutout. Moreover, the flexible, normally elastic deformation of the connecting section by the cutout allows a locally secure configuration of the second connecting section in the opening after the periphery of the second connecting section is pressed against the inside of the opening by an elastic recovery.

The embodiment of the universal adapter according to the invention accordingly makes it possible to use the universal adapter for an abrasive-tight connection to a plurality of cylinder heads that have different shapes and geometries of inlet openings. During operating an automobile workshop, a costly purchase of different suction adapters that are only provided for connecting to a specific cylinder head is accordingly unnecessary.

In principle, the embodiment of the cutout is freely selectable. It is also possible to place a plurality of cutouts distributed over the circumference in the region of the second connecting section to further increase the range of use of the universal adapter. However, according to one particularly advantageous embodiment of the invention, the cutout is constructed to be V-shaped. The V-shaped embodiment of the cutout makes it possible to construct a single cutout in a particularly variable manner when using a single cutout, which yields a wide range of use of the universal adapter for connecting to a plurality of openings of different working chambers. Moreover, a V-shaped cutout can be produced very easily and inexpensively, for example by punching.

The remaining construction of the universal adapter is also freely selectable in principle. However, according to a particularly advantageous embodiment of the invention, it is provided that the first connecting section is also formed from a flexible material and, particularly preferably, is expanded conically at its free end.

The first connecting section serves to connect the universal adapter to a suction line of a suction unit. For this purpose, the first connecting section must, for example, be disposed on a suction port of a suction line. The use of a flexible material for constructing the first connecting section makes it easier to place the universal adapter on such a suction port. Moreover, due to its elastic properties, the flexible material ensures a reliable connection of the universal adapter to the suction port. A conical construction of the first connecting section, which is understood to be an embodiment in which the first connecting section expands like a funnel at its free end, facilitates the configuration on a suction port of the suction line in a supplementary manner, and accordingly enables comfortable installation of the universal adapter.

The entire universal adapter as well as the main tube can be made of any material, providing that at least the second connecting section is made of a flexible material in accordance with the invention. Accordingly, it is possible in principle to construct the main tube in several parts and then connect the individual sections with each other. According to a particularly advantageous embodiment of the invention, the main tube is however made as a single part with the connecting sections formed of a flexible material. A corresponding embodiment of the invention is distinguished in that it is particularly easy and economical to produce. Moreover, the consistent use of a flexible material makes it possible to easily align the universal adapter by elastically bending for connection with the suction line, since the flexibility of the material offers sufficient room for maneuvering in this regard.

According to another embodiment of the invention it is provided that a sealing collar is disposed on the main tube that can be adjusted between a sealing position projecting beyond the free end of the second connecting section, and an installation position that exposes at least the cutout. According to this further embodiment of the invention, a sealing collar is adjustably disposed on the main tube of the universal adapter, wherein the sealing collar projects beyond the free end of the second connecting section when in the sealing position and accordingly lies against a surface surrounding the opening when the universal adapter is in the installed position in which the second connecting section is disposed in an opening of the working chamber, for example the cylinder head, and thereby additionally seals the opening and prevents the abrasive from leaving so that harm to the operating personnel from exiting abrasive can be very reliably prevented.

In this regard, the sealing collar can be made of any material. However, it is preferably made of a flexible plastic which provides an effective seal and adaptation to the surface against which the sealing collar lies in the region of the opening. When the sealing collar is in the installed position, the adjustability of the sealing collar makes it possible to place the main tube comfortably with the second connecting section in the opening of the working chamber. Then the sealing collar can be transitioned into the sealing position in which the opening is reliably sealed and the blasting process can start.

The abrasive can in principle be introduced into the working chamber at any location, for example the intake ducts of a cylinder head. However according to one particularly advantageous embodiment of the invention, the main tube has a tube hole in its periphery that penetrates the tube casing and is oriented toward the second connecting section. According to this embodiment of the invention, the tube hole constitutes an opening in the main tube through which the blasting tube by which the abrasive is introduced into the working chamber can be guided through the main tube into the working chamber. The orientation of the tube hole toward the second connecting section ensures that the tube is well-guided while being introduced into the main tube, and ensures that the tube enters the working chamber.

With this embodiment of the invention, additional access openings that may have to be sealed can be omitted. The flexible embodiment of the main tube provided according to a preferred further embodiment is particularly advantageous since it offers an automatic seal of the tube against the main tube when the diameter of the tube hole is correspondingly adapted to the tube to be inserted. For example, various types of plastics are suitable as flexible materials, and particularly preferably, the main tube is for example made of a textile-reinforced plastic hose.

The tube hole can in principle be routed in any manner desired toward the second connecting section. According to a particularly advantageous embodiment of the invention, however, a longitudinal axis of the tube hole encloses an angle with the longitudinal axis of the main tube of 10° to 60°, preferably 15° to 40°, particularly preferably 20° to 30°.

The angles of the tube hole provided according to this further embodiment of the invention make it possible to introduce the tube through the tube hole into the working chamber in a particularly comfortable and easy manner. In particular, an angle of the tube hole relative to the longitudinal axis of particularly preferably 20° to 30°, in particular 25°, is an angle that allows optimum positioning of the tube hole within the working chamber.

The tube hole can in principle be disposed at any location in the main tube. According to a particularly advantageous embodiment of the invention, however, it is provided that the tube hole is disposed in the region between the second connecting section and a middle section of the main tube. A corresponding configuration of the tube hole makes it possible to very easily and comfortably introduce the tube into the main tube and be disposed with the tube opening in the working chamber, even when the universal adapter is in an installed state. Moreover, the tube can be moved within the tube hole which, due to the introduced abrasive, allows the entire working chamber to be cleaned of impurities that can also be removed through the suction tube like the introduced abrasive.

According to another embodiment of the invention it is further provided that the tube hole is disposed on the side of the main tube opposite the cutout. According to this embodiment of the invention, the tube hole runs opposite to the cutout in the main tube, and it is shifted in the direction of the longitudinal axis toward the first connecting section. A corresponding configuration of the tube hole relative to the cutout ensures a particularly high stability of the main tube.

Other features which are considered as characteristic for the invention are set forth in the appended claims.

Although the invention is illustrated and described herein as embodied in a universal adapter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
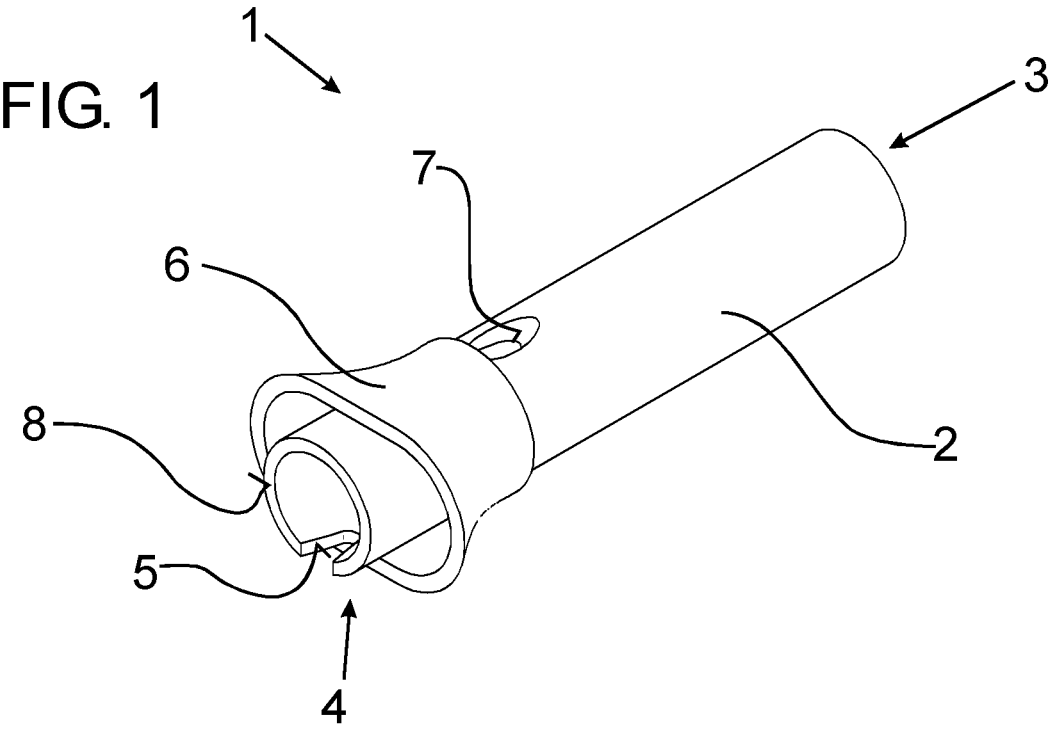
FIG. 1 is a diagrammatic, perspective view of a universal adapter.
Figure 2:
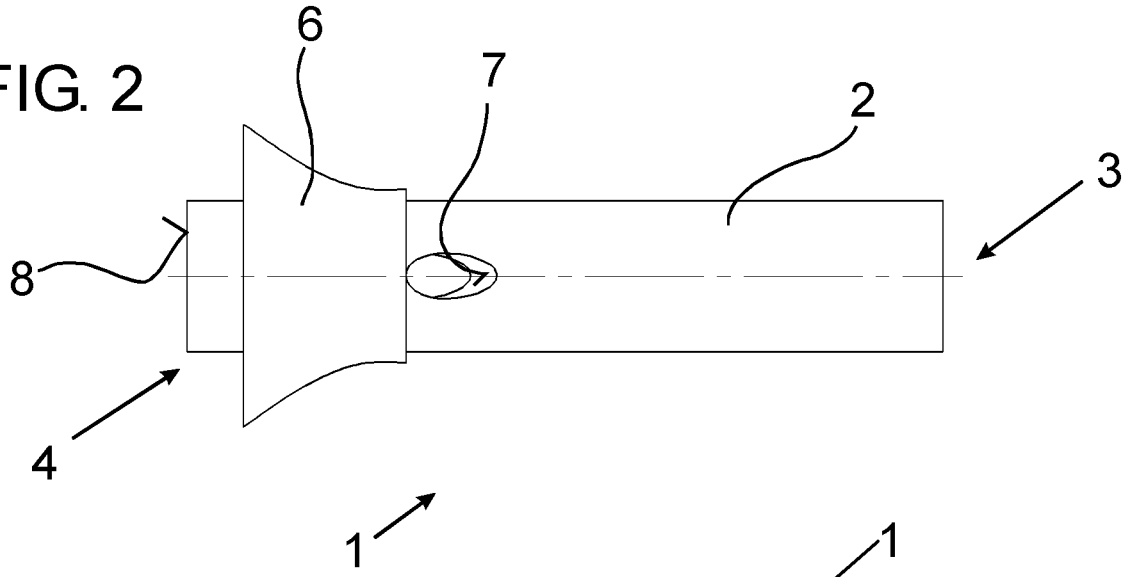
FIG. 2 is a top-plan view of the universal adapter of FIG. 1.
Figure 3:
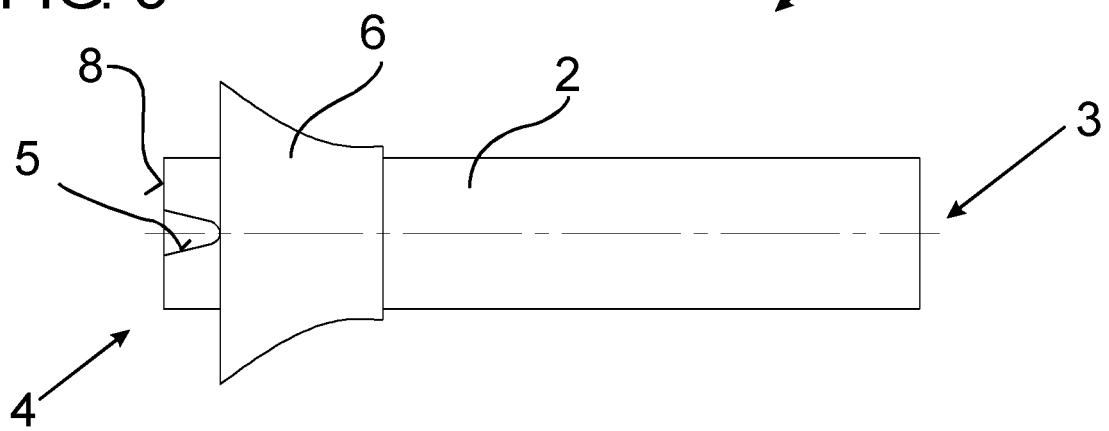
FIG. 3 is a bottom-plan view of the universal adapter of FIG. 1.

Referring now in detail to FIGS. 1 to 3 of the drawings as a whole, there is seen an embodiment of a universal adapter 1. The universal adapter 1 has a main tube 2 produced from a textile-reinforced plastic that has a V-shaped cutout 5 in its second connecting section 4 to be disposed in various openings of working chambers (not shown in this case) of, for example, different cylinder heads. The cutout 5, which penetrates the tube casing, extends toward a first connecting section 3 in the direction of a longitudinal axis of the main tube 2 starting from an end face 8 of the second connecting section 4 and makes it possible to compress or upset the second connecting section 4 in the region of the cutout 5 so that the diameter changes due to opposing end faces of the cutout 5 approaching one another. The second connecting section 4 can accordingly be disposed in openings of working chambers with different diameters.

A sealing collar 6 is disposed coaxially to the main tube 2 and is shown in its installed position in FIG. 1 to FIG. 3. In the installed position, the accessibility to the second connecting section 4 allows it to be easily disposed in an opening of the working chamber. After placement of the second connecting section 4, the sealing collar 6 is then moved toward the free end of the second connecting section 4 until its sealing surface running parallel to the end face 8 lies against the surface in the region around the opening in which the second connecting section 4 is disposed.

A tube hole 7 penetrating the tube casing and being disposed on the side opposite the cutout 5 runs toward the second connecting section 4 in a middle region of the main tube 2. The tube hole 7 makes it possible to provide a blasting tube (not shown herein) through the use of which an abrasive is introduced into the working chamber.

The following is a summary list of reference numerals and the corresponding structure used in the above description of the invention:

1 Universal adapter
2 Main tube
3 First connecting section
4 Second connecting section
5 Cutout
6 Sealing collar
7 Tube hole
8 Face

The invention claimed is:

1. A universal adapter, comprising:

a main tube for a combined suction unit and granulate blasting unit, said main tube having a longitudinal axial direction, a first connecting section to be connected to a suction line of the suction unit and a second connecting section being configured to be connected to a working chamber;

said second connecting section being formed of a flexible material, said second connecting section having a free end and said second connecting section having a periphery with a cutout formed therein for changing a diameter of said free end of said second connecting section; and said cutout extending from said free end in said longitudinal axial direction.

2. The universal adapter according to claim 1, wherein said cutout is V-shaped.

3. The universal adapter according to claim 1, wherein said first connecting section is formed of a flexible material.

4. The universal adapter according to claim 1, wherein said first connecting section has a free end expanding conically.

5. The universal adapter according to claim 1, wherein said main tube is formed as a single part having said connecting sections formed of a flexible material.

6. The universal adapter according to claim 1, which further comprises a sealing collar disposed on said main tube, said sealing collar being adjustable between a sealing position projecting beyond said free end of said second connecting section and an installation position exposing at least said cutout.

7. The universal adapter according to claim 1, wherein said main tube has a periphery and a tube hole formed in said periphery of said main tube and oriented toward said second connecting section.

8. The universal adapter according to claim 7, wherein:

said main tube has a longitudinal axis extending in said longitudinal axial direction; and said tube hole has a longitudinal axis enclosing an angle of 10° to 60° with said longitudinal axis of said main tube.

9. The universal adapter according to claim 7, wherein:

said main tube has a longitudinal axis extending in said longitudinal axial direction; and said tube hole has a longitudinal axis enclosing an angle of 15° to 40° with said longitudinal axis of said main tube.

10. The universal adapter according to claim 7, wherein:

said main tube has a longitudinal axis extending in said longitudinal axial direction; and said tube hole has a longitudinal axis enclosing an angle of 20° to 30° with said longitudinal axis of said main tube.

11. The universal adapter according to claim 7, wherein said main tube has a middle section disposed between said first and second connecting sections, and said tube hole is disposed in a region between said second connecting section and said middle section.

12. The universal adapter according to claim 7, wherein said main tube has a side opposite said cutout, and said tube hole is disposed on said side of said main tube opposite said cutout.

13. The universal adapter according to claim 1, wherein said cutout has opposing end faces approaching one another and reducing a diameter of said second connecting section in an installed condition of said second connecting section in an opening of a working chamber.

14. A universal adapter, comprising:

a main tube for a combined suction unit and granulate blasting unit, said main tube having a longitudinal axial direction, a first connecting section to be connected to a suction line of the suction unit and a second connecting section to be connected to a working chamber;

said second connecting section being formed of a flexible material, said second connecting section having a free end and said second connecting section having a periphery with a cutout formed therein;

said cutout extending from said free end in said longitudinal axial direction; and a sealing collar disposed on said main tube, said sealing collar being adjustable between a sealing position projecting beyond said free end of said second connecting section and an installation position exposing at least said cutout.

* * * * *